United States Patent [19]

Schwär

[11] Patent Number: 4,505,071

[45] Date of Patent: Mar. 19, 1985

[54] CRANKSHAFT-FINISHING MACHINE

[75] Inventor: Rudolf Schwär, Wuppertal, Fed. Rep. of Germany

[73] Assignee: Maschinenfabrik Ernst Thielenhaus GmbH, Wuppertal, Fed. Rep. of Germany

[21] Appl. No.: 551,683

[22] Filed: Nov. 14, 1983

[30] Foreign Application Priority Data

Nov. 13, 1982 [DE] Fed. Rep. of Germany ..... 3242095

[51] Int. Cl.[3] ..... B24B 5/42

[52] U.S. Cl. ..... 51/3; 51/58; 51/67; 51/73 GC; 51/161

[58] Field of Search ..... 51/58, 241 R, 347, 161, 51/67, 3, 73 GC

[56] References Cited

U.S. PATENT DOCUMENTS

| | | | |
|---|---|---|---|
| 1,993,543 | 3/1935 | Egger | 51/73 GC |
| 3,526,966 | 2/1971 | Schwar | 51/241 R |
| 3,548,546 | 12/1970 | Thielenhaus | 51/58 |

*Primary Examiner*—Harold D. Whitehead

*Attorney, Agent, or Firm*—Karl F. Ross; Herbert Dubno

[57] ABSTRACT

A machine for finish-grinding of both axial and off-axial sections of a crankshaft, rotating about a main axis and oscillating therealong, comprises fixed first holders interleaved with movable second holders. The first holders support respective sets of primary tool carriers, three per set, equipped with abrasive stones that are equispaced about the main axis and act as intermediate bearings for the crankshaft. The second holders support similar sets of secondary tool carriers each with three abrasive stones defining a working axis. Each second holder, connected with the machine frame through an articulated linkage, is bracketed by two first holders and is guided by their flat surfaces with the aid of three sliders equispaced about the corresponding working axis; the sliders have recessed contact faces communicating with a source of hydraulic oil acting as a pressure fluid and as a lubricant.

10 Claims, 2 Drawing Figures

CRANKSHAFT-FINISHING MACHINE

FIELD OF THE INVENTION

My present invention relates to a machine for the finish-grinding or polishing of a crankshaft having axial and off-axial cylindrical sections, namely bearing pins and crankpins, interconnected by transverse webs.

BACKGROUND OF THE INVENTION

In my commonly owned U.S. Pat. No. 3,562,966 I have disclosed an apparatus of this type in which a crankshaft being machined is mounted on a lathe for rotation about its main axis, each of the pins being surrounded by a jaw-shaped housing movable between guide plates which in turn are laterally slidable on rails paralleling that axis. Each housing contains three tool carriers which are angularly equispaced about the respective pin and are provided with abrasive stones in contact with the pin's surface. The tool carriers of each housing are jointly displaceable in a radial direction by intermeshing gears and racks under the control of a hydraulic servomotor.

While the housing engaging the bearing pins theoretically remain centered on the main axis and thus are held stationary during rotation of the crankshaft, the housings associated with the eccentric crankpins orbit about that axis while sliding between their guide plates with a pitman-like motion. In practice, however, the weight of the horizontally supported crankshaft causes it to bend away from the axis of rotation wherefore also the housings associated with the bearing pins are allowed a certain mobility by being flexibly or otherwise yieldably suspended. Actually, though, the resulting adaptability of the positions of the tool carriers to the excursions of the bearing pins has the drawback that surface irregularities due to manufacturing tolerances—often aggravated by an annealing or hardening treatment to which the crankshaft is subjected between coarse machining and finish-grinding—are not properly eliminated. In fact, the deviations of the pins from the axial direction tend to give rise to further surface deformations which may make the crankshaft unsuitable for high-precision operation.

OBJECT OF THE INVENTION

Thus, the object of my present invention is to provide an improved machine for the purpose described which obviates the aforestated deficiences and thus enables a precise finishing of both bearing pins and crankpins of a crankshaft.

SUMMARY OF THE INVENTION

In common with the apparatus disclosed in my prior U.S. Pat. No. 3,562,966, the machine according to my present invention includes drive means for rotating a crankshaft about a horizontal axis, primary tool carriers provided with first grinding means positioned for engagement with the axial sections (bearing pins) of the crankshaft, and secondary tool carriers provided with second grinding means positioned for engagement with its off-axial sections (crankpins). The primary tool carriers, pursuant to the present improvement, are mounted on first holders secured in mutually fixed positions to a frame portion of the machine for supporting the crankshaft by its axial sections even while finishing same whereas the secondary tool carriers are mounted on second holders that are movably guided along parallel confronting surfaces of adjacent first holders for following the excursions of the off-axial sections.

Pursuant to a more particular feature of my invention, the second holders are provided with guide members which slidably engage the confronting surfaces of the adjoining first holders and preferably are provided with conduit means connecting them to a source of hydraulic fluid under pressure.

In accordance with yet another feature of this invention, I provide each second holder on each side with a plurality of such guide members—preferably three—which engage the confronting surface at locations angularly spaced about a working axis that is parallel to the horizontal main axis and is defined by a set of secondary tool carriers associated with the respective second holder. By this means, each second holder has a statically and dynamically determined attitude so that its motion is positively maintained in a vertical plane perpendicular to the main axis.

Since the primary tool carriers of each first holder have the dual task of finishing a bearing pin and keeping that pin centered on the main axis, the first grinding means preferably consists of three abrasive stones angularly equispaced about that axis and mounted for joint radial displacement in the manner described in my above-identified prior patent. Although the second grinding means operating on the crankpins could have a variety of forms, possibly including abrasive tapes partly enveloping the respective crankpins, I prefer to use the same kind of three-stone assembly also for the second holders in order to provide a positive definition of their working axes.

BRIEF DESCRIPTION OF THE DRAWING

The above and other features of my invention will now be described in detail with reference to the accompanying drawing in which.

SPECIFIC DESCRIPTION

Figure 1:
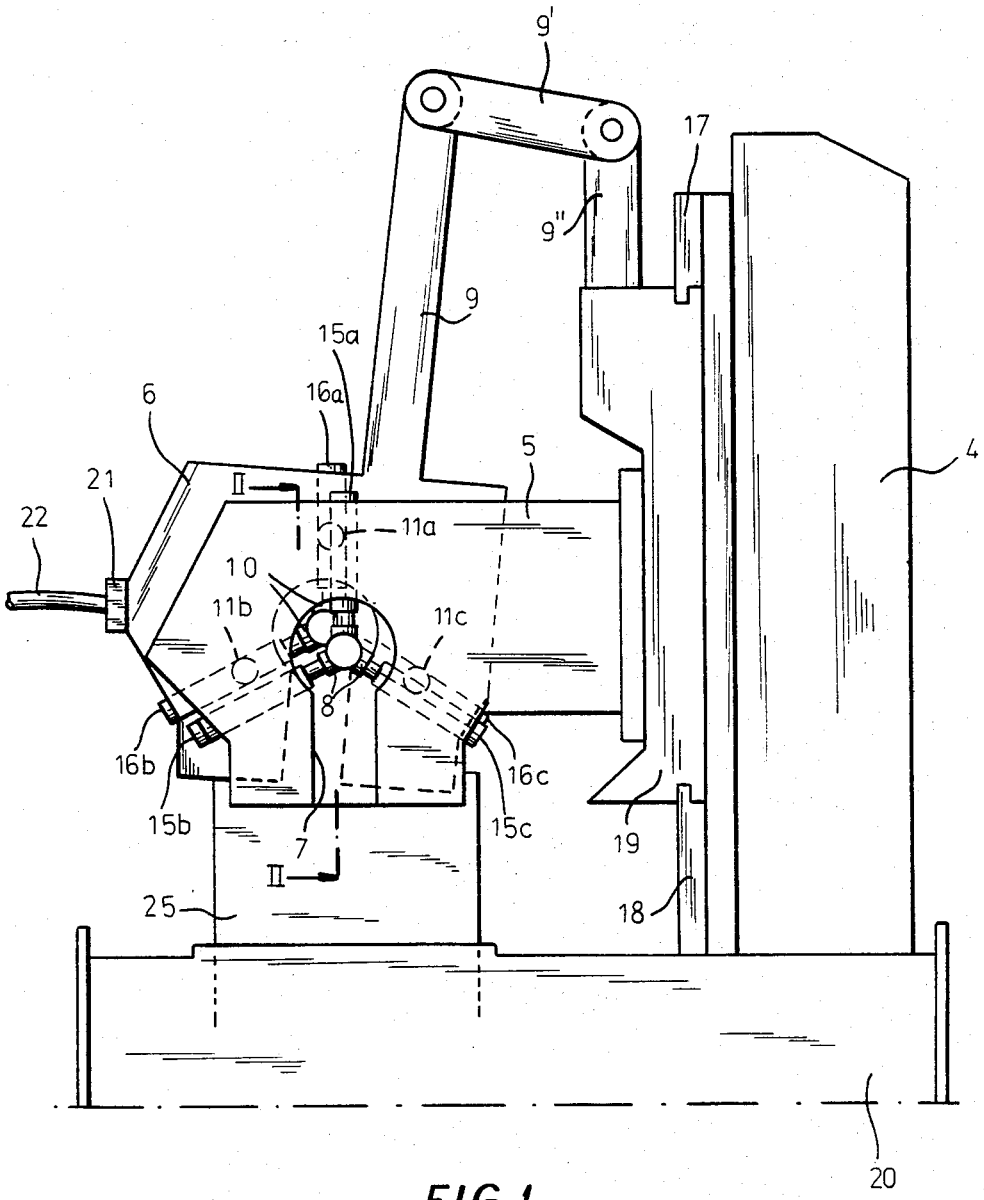
FIG. 1 is a side-elevational view of a machine embodying the present invention.

As shown in the drawing, a machine for the finish-grinding or polishing of bearing pins 1 and crankpins 2 of a crankshaft 3 comprises a bed 20 with an upright frame portion 4 on which a carriage 19 is limitedly horizontally slidable between rails 17 and 18. The crankshaft 3 has a horizontal axis O about which it is rotated by a drive unit 24 connected with the headstock of a lathe whose tailstock is mounted on a pedestal 25 seen in FIG. 1. Crankpins 2 are centered on respective axes Q, parallel to main axis O, and are separated from bearing pins 1 by transverse webs 23 between which the heads of respective first and second sets of tool carriers 15*a*, 15*b*, 15*c* and 16*a*, 16*b*, 16*c* are angularly equispaced about the respective pins 1 and 2. The three tool carriers 15*a*–15*c* of each first set are adjustably but fixedly mounted on a respective first holder 5 which is designed as a vertical plate or block immovably secured to carriage 19. The three tool carriers 16*a*–16*c* of each second set are similary mounted on a respective second holder 6 which is supported on carriage 19 by an articulated linkage 9, 9', 9'' so as to be freely displaceable in a predetermined vertical plane. Since the number of bearing pins 1 is one more than the number of crankpins 2, each second holder 6 is bracketed by two first holders 5. The sets of tool carriers 15a–15c and 16a–16c respectively support abrasive stones 8 and 10 for the finishing of bearing pins 1 and crankpins 2; the first tool-carrier sets are angulary equispaced about main axis O while the second tool-carrier sets are equispaced about the individual axes Q of the crankpins to be polished thereby. Another drive unit, not shown, is coupled with carriage 19 for reciprocating same at a relatively slow rate whereby the rotating crankshaft 3 is axially shifted relatively to the tool carriers, within the limits of the spacing of webs 23, as indicated by an arrow B in FIG. 2. It will, of course, also be possible to attach the holders 5 and the links 9'' directly to the stationary frame portion 4 and to impart a horizontal reciprocation to the lathe supporting the crankshaft 3.

Figure 2:
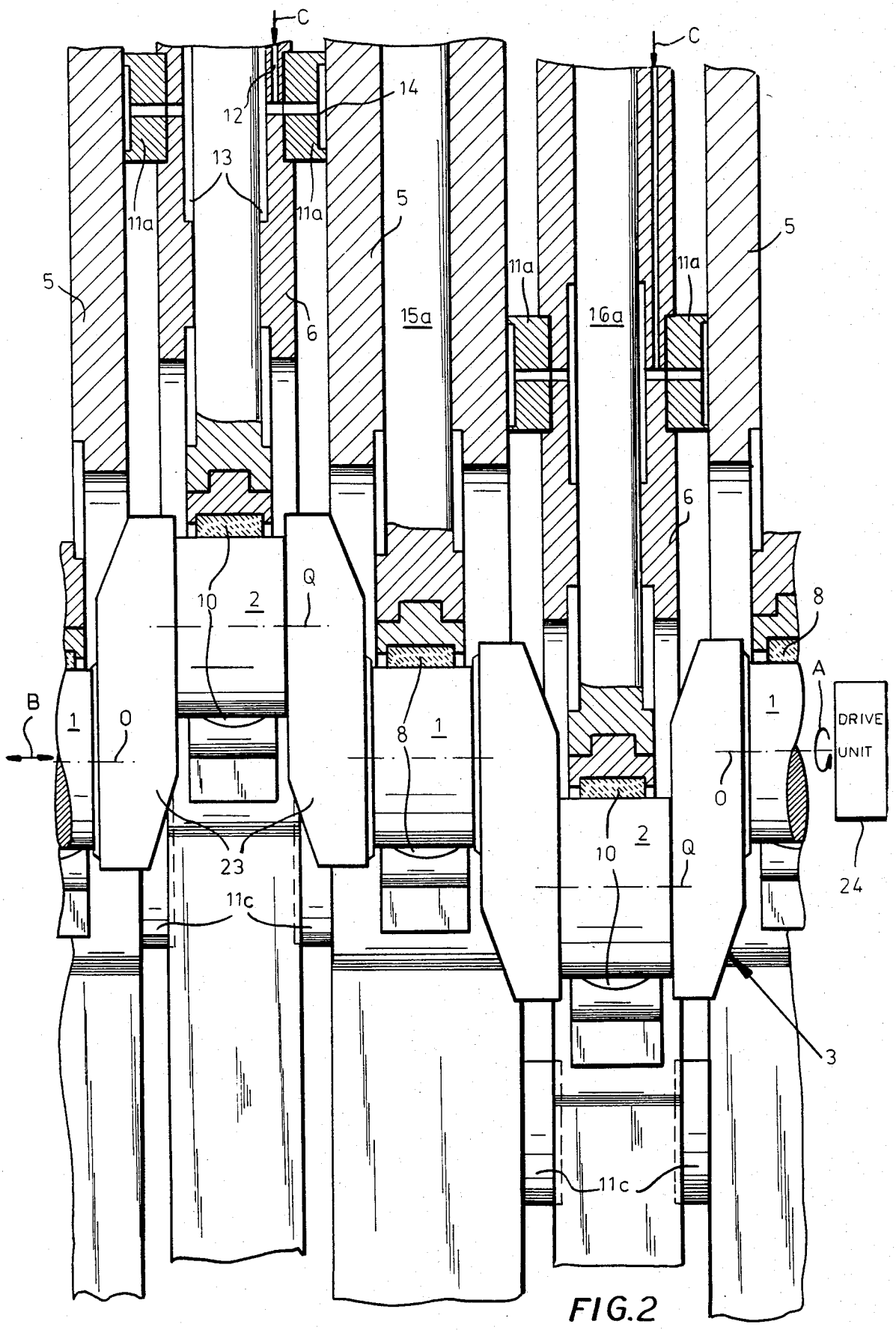
FIG. 2 is a fragmentary sectional view drawn to a larger scale and taken on the line II—II of FIG. 1.

Holders 5 and 6 are generally of inverted-U shape roughly similar to that of the housings of U.S. Pat. No. 3,562,965, as seen in FIG. 1, so as to have a downwardly open mouth 7 for introduction of the crankshaft into their central cutouts into which the respective tool carries radially project. Each holder 6 is provided on each side with three guide members in the form of disk-shaped sliders 11a, 11b, 11c which are angularly equispaced about the corresponding working axis defined by its tool carriers and coinciding with the respective crankpin axis Q. The angular spacing of sliders 11a–11c about that working axis corresponds to that of the tool carriers 16a–16c, i.e. 120° apart. Each slider is seen to engage a flat surface of an adjoining first holder 5 by a contact face having a recess 14 communicating with an annular clearance 13 which surrounds the stem of the respective tool carrier 16a–16c. Each recess 14 receives hydraulic fluid (oil) under pressure from a nonillustrated source, via a channel 12 (FIG. 2) connected through a coupling 21 (FIG. 2) to a flexible supply line 22, as indicated by arrows C; the oil accumulating in these recesses helps center each holder 6 between the two bracketing holders 5 and also lubricates the surface engaged by the sliders as it leaks out through the very narrow gaps existing between these surfaces and the sliders.

Naturally, the holders 5 fixed to carriage 19 must be wide enough to let their mutually parallel lateral surfaces be in continuous contact with all sliders of the adjoining holders 6.

I claim:

1. In a machine for finish-grinding a crankshaft with axial and off-axial cylindrical sections interconnected by transverse webs, including drive means for rotating said crankshaft about a horizontal axis, primary tool carriers provided with first grinding means positioned for engagement with said axial sections, and secondary tool carriers provided with second grinding means positioned for engagement with said off-axial sections, the improvement wherein said primary tool carriers are mounted on first holders secured in mutually fixed positions to a frame portion for supporting said crankshaft by said axial sections, said secondary tool carriers being mounted on second holders movably guided along parallel confronting surfaces of adjacent first holders for following the excursions of said off-axial sections.

2. A machine as defined in claim 1 wherein said second holders are provided with guide members slidably engaging said confronting surfaces.

3. A machine as defined in claim 2 wherein said guide members are provided with conduit means connecting same to a source of hydraulic fluid under pressure.

4. A machine as defined in claim 3 wherein each of said guide members has a recessed face communicating with said conduit means and contacting the confronting surface of the adjacent first holder.

5. A machine as defined in claim 2 wherein each of said second holders is provided on each side with a plurality of said guide members engaging the confronting surface at locations angularly spaced about a working axis, parallel to said horizontal axis, defined by a set of said secondary tool carriers associated with the respective second holder.

6. A machine as defined in claim 5 wherein said plurality comprises three guide members substantially equispaced about said working axis.

7. A machine as defined in claim 6 wherein said set encompasses three secondary tool carriers spaced 120° apart and equipped with abrasive stones constituting said second grinding means.

8. A machine as defined in claim 7 wherein each of said first holders is provided with three primary tool carriers spaced 120° apart about said horizontal axis and equipped with abrasive stones constituting said first grinding means.

9. A machine as defined in claim 1 wherein said second holders are connected with said frame portion by means of articulated linkages.

10. A machine as defined in claim 1 wherein said drive means is operable to superpose an oscillatory axial motion relative to said frame portion upon the rotation of said crankshaft.

* * * * *